US006222312B1

(12) United States Patent
Ghosh et al.

(10) Patent No.: US 6,222,312 B1
(45) Date of Patent: Apr. 24, 2001

(54) FLUORESCENT LAMP HAVING WIDE BANDWIDTH BLUE-GREEN PHOSPHOR

(75) Inventors: Snehasish Ghosh; Charles Trushell; Manuel Oomen, all of Morgantown, WV (US)

(73) Assignee: Philips Electronics North America Corp., New York, NY (US)

( * ) Notice: Subject to any disclaimer, the term of this patent is extended or adjusted under 35 U.S.C. 154(b) by 0 days.

(21) Appl. No.: 09/527,703

(22) Filed: Mar. 17, 2000

(51) Int. Cl.[7] ..... H01J 1/62

(52) U.S. Cl. ..... 313/487; 362/217; 362/260; 362/263; 313/484; 313/485; 313/486; 313/493; 313/634; 313/635

(58) Field of Search ..... 362/217, 260, 362/263, 484; 313/485–487, 635, 634, 637, 638, 642, 639, 493

(56) References Cited

U.S. PATENT DOCUMENTS

| | | | | |
|---|---|---|---|---|
| 5,714,836 | * | 2/1998 | Hunt et al. | 313/487 |
| 5,808,409 | * | 9/1998 | Matsuda et al. | 313/486 |
| 5,838,101 | * | 11/1998 | Pappalardo | 313/487 |
| 5,854,533 | * | 12/1998 | Pappalardo | 313/487 |
| 5,994,831 | * | 11/1999 | Van der Voort et al. | 313/486 |

FOREIGN PATENT DOCUMENTS

| | | | |
|---|---|---|---|
| 067030 | 12/1982 | (EP) | H01J/61/42 |
| 296536 | 12/1988 | (EP) | H01J/61/94 |
| 364124 | 4/1990 | (EP) | H01J/61/44 |
| 162384 | 3/1989 | (JP) | C09K/11/08 |
| 528966 | 2/1993 | (JP) | H01J/61/44 |
| 536384 | 12/1993 | (JP) | H01J/61/44 |

* cited by examiner

*Primary Examiner*—Thomas M. Sember
*Assistant Examiner*—Ismael Negron
(74) *Attorney, Agent, or Firm*—F. Brice Faller

(57) ABSTRACT

A fluorescent lamp includes a discharge tube with an ionizable filling which emits ultraviolet light when a discharge occurs, and an inside surface coated with a mixture of three phosphors which emit light in blue-green, green, and red wavelength ranges when exposed to the ultraviolet light. The green and red phosphors are conventional, for example LAP and YOX, while the blue-green phosphor is barium magnesium aluminate activated by europium and manganese (BBG). The BBG has spectra which are similar to those of conventional blue phosphors such as BAM or SCAP, but also emits in the green range from 500–540 nm and augments the LAP which is relatively low in this range.

18 Claims, 4 Drawing Sheets

FLUORESCENT LAMP HAVING WIDE BANDWIDTH BLUE-GREEN PHOSPHOR

BACKGROUND OF THE INVENTION

The invention relates to a fluorescent lamp having a sealed discharge vessel with an inside surface provided with a layer of luminescent material which is a mixture of phosphors which luminesce in different wavelength ranges to produce white light.

Fluorescent lamps typically have a transparent glass envelope enclosing a sealed discharge space containing an inert gas and mercury vapor. When subjected to a current provided by electrodes, the mercury ionizes to produce radiation having primary wavelengths of 185 nm and 254 nm. This ultraviolet radiation, in turn, excites phosphors on the inside surface of the envelope to produce visible light which is emitted through the glass. The phosphors are typically chosen to emit light in each of the three primary colors and are therefore referred to as red, green, and blue phosphors.

EP 0 067030 discloses a fluorescent lamp having a glass tube coated with a mixture of phosphors including at least one red phosphor, at least one green phosphor, and at least one blue phosphor. The red phosphor may include yttrium oxide activated by europium (YOX), which is usually the sole red emitter. The green phosphor may include lanthanum phosphate activated by cerium and terbium (LAP). The blue phosphor may include barium magnesium aluminate activated by europium (BAM) and/or strontium calcium halophosphate activated by europium (SCAP). EP 067030 recognizes that wall loading ($W/m^2$) increases as the diameter of the envelope decreases. The intensity of ultraviolet radiation having wavelengths of 185 nm and 254 nm also increases. However the 185 nm wavelength damages conventional phosphors, so it is not possible to achieve the desired lumen maintenance. The problem is addressed by increasing the relative amount of red phosphor, which absorbs the 185 nm radiation and prevents deterioration of the blue and green phosphors. This improves luminous flux and maintenance factor but skews the chromaticity toward red. Further, some blue and green phosphors have a high consumption of mercury, making them unsuitable for use in low mercury lamps regardless of wall loading.

The apparent color of a light source is described in terms of color temperature, which is the temperature of a black body that emits radiation of about the same chromaticity as the radiation considered. A light source having a color temperature of 3000° K. therefore has a larger red component than a light source having a color temperature of 4100° K. The color temperature of a phosphor mixture can be varied by changing the ratio of the phosphors.

Color quality is further described in terms of color rendering, and more particularly color rendering index (CRI or $R_a$), which is a measure of the degree to which the psycho-physical colors of objects illuminated by a light source conform to those of a reference illuminant for specified conditions.

CRI is in effect a measure of how well the spectral distribution of a light source compares with that of an incandescent (blackbody) source, which has a Planckian distribution between the infrared (over 700 nm) and the ultraviolet (under 400 nm). The discrete spectra which characterize phosphor mixtures will yield good color rendering of objects whose colors match the spectral peaks, but not as good of objects whose colors lie between the spectral peaks.

SUMMARY OF THE INVENTION

The invention aims to provide a fluorescent lamp of the type having a mixture of phosphors on the inside surface of a discharge vessel, which offers a good color rendering throughout the visible range, in particular a mixture which achieves a CRI of 87.

It is a further object to provide a lamp having good color maintenance at wall loading in the range of 200 to 400 $W/m^2$. A T12 lamp has a wall loading of 234 $W/m^2$, while a T8 lamp has a wall loading of 349 $W/m^2$.

It is a further object to provide a lamp having low mercury consumption. This permits a low mercury lamp with a high lumen maintenance factor.

These and other objects are achieved with an arc discharge lamp having a layer of luminescent material on the inside surface of the discharge vessel, which layer includes a red phosphor, a green phosphor, and a blue-green phosphor, the latter being barium magnesium aluminate activated by europium and manganese (BBG).

In the critical green wavelength range from 500 to 540, which is near where the human eye is most sensitive, BBG has a higher light output than either SCAP or BAM, which are commonly used blue phosphors. The mixture exhibits good color point maintenance over the life of the lamp, because BBG is less prone to degradation by the 185 nm mercury emission than SCAP, and less prone to mercury consumption than BAM or SCAP.

DESCRIPTION OF THE PREFERRED EMBODIMENTS

Figure 1:
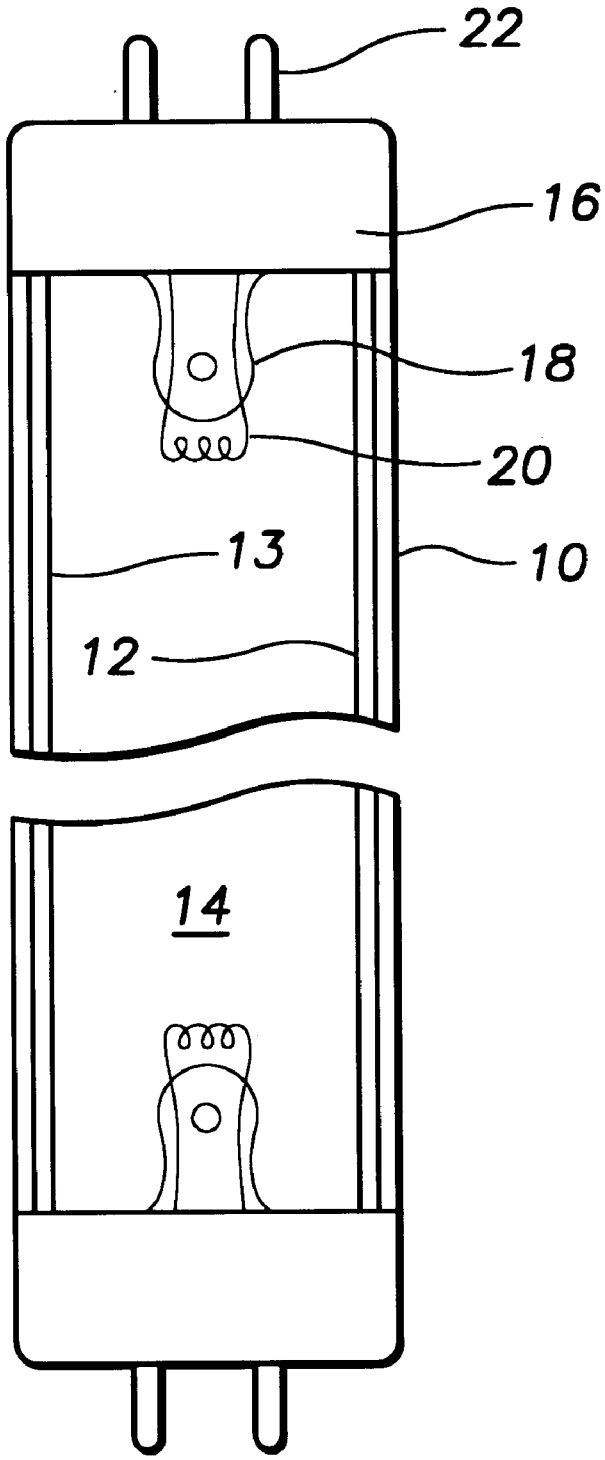
FIG. 1 is a schematic cross-section of a fluorescent lamp.

FIG. 1 shows a conventional fluorescent lamp having a discharge vessel 10 formed as a glass tube having an inside surface 12 enclosing a discharge space 14 which contains an ionizable medium including an inert gas and mercury. The tube has metal end caps 16 sealed to opposite ends thereof with glass in which stems 18 are formed to support electrodes 20. The electrodes 20 are provided with current by mutually insulated pins 22 which are received in a socket. The glass tube has an internal diameter of 1.0 inch, which makes it a T8 lamp. The wall loading is 349 $W/m^2$, which is 67% higher than the 234 $W/m^2$ of a T12 lamp, which has a 1.5 inch ID.

While the lamp described above is a conventional T8 type fluorescent lamp, it is provided on its inside surface 12 with a layer 13 of luminescent material including a red phosphor, a green phosphor, and a blue-green phosphor. According to the preferred embodiment the layer consists of only three phosphors, wherein the red phosphor is YOX, the green phosphor is LAP, and the blue-green phosphor is BBG.

The only difference between BBG and the blue phosphor BAM in the luminescent layer according to the prior art is the presence of manganese atoms, in addition to europium atoms, as activators in the barium magnesium aluminate lattice.

Both the Eu and Mn atoms in the lattice create defects which result in emissions at characteristic wavelengths. The presence of Mn results in more emissions in the range from 500 to 540 nm, as shown in FIGS. 2 and 3.

Figure 2:
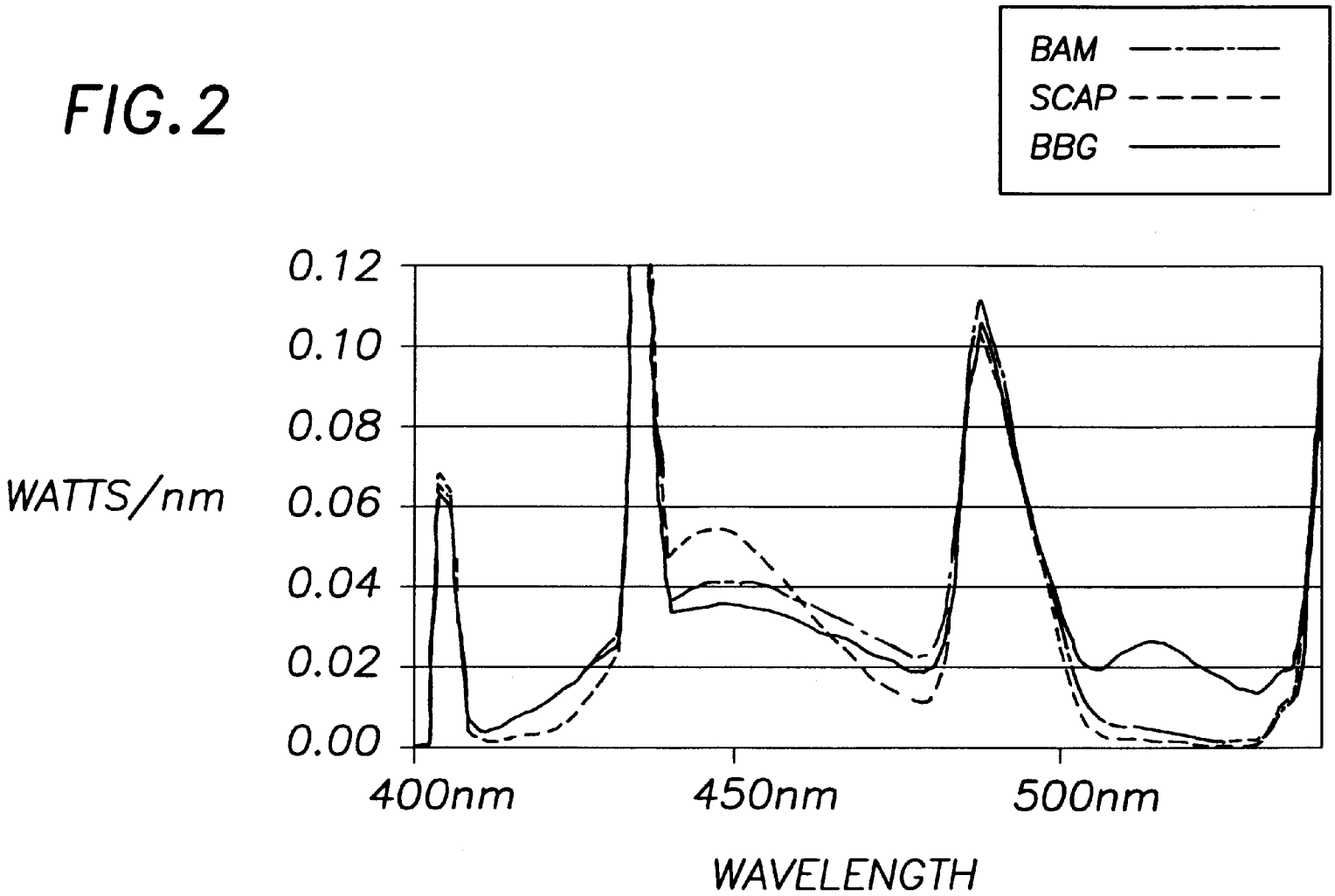
FIG. 2 is a plot of light output versus wavelength for a lamp having a layer of luminescent material according to the invention, yielding a color temperature of 4100° K.
Figure 3:
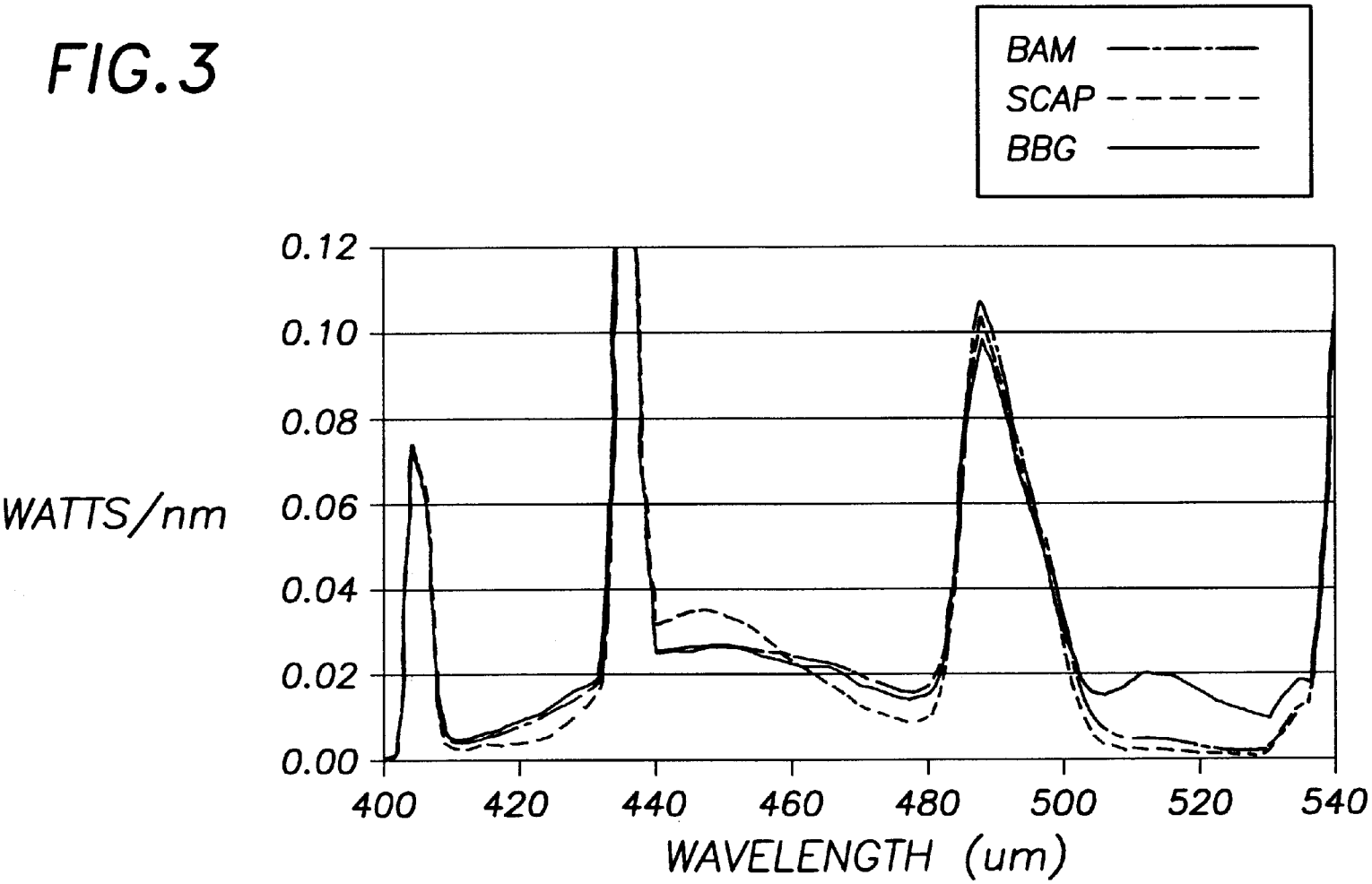
FIG. 3 is a plot of light output versus wavelength for a lamp having a layer of luminescent material according to the invention, yielding a color temperature of 3500° K.

FIGS. 2 and 3 show the amount of emission (measured in watts) versus wavelength for the visible spectrum between 400 and 540 nm, for a three phosphor layer according to the invention (solid line, BBG) and two layers according to the prior art (dashed line, SCAP, and dotted line, BAM). For all three layers the red phosphor is YOX and the green phosphor is LAP, so the plots show the difference between the inventive mixture with the blue green BBG and the prior art mixtures with the blue SCAP and BAM phosphors. Spectral intensities in the red range above 540 nm are substantially the same for all three mixtures.

FIG. 2 shows a plot of a mixture which achieves a color temperature of 4100° K., which contains 12% BBG, 57% YOX, and 31% LAP. FIG. 3 shows a plot of a mixture which achieves a color temperature of 3500° K., which contains 7% BBG, 63% YOX, and 30% W LAP. The curves for SCAP and BAM in lieu of BBG have slightly different percentages. Particle sizes are on the order of 6 $\mu$, the phosphor layer is on the order of 12 $\mu$ thick, and is coated on an intermediate layer, for example alumina, which is coated directly on the glass to prevent the glass from absorbing mercury.

Mercury is present in droplets when the lamp is cold, and vaporizes to a partial pressure of 0.5 to 0.8 Pa when the lamp (T8) is operating. The phosphor combination according to the invention, when placed over a precoat on the inside surface of the discharge vessel, has negligible absorption of mercury and phosphor degradation, whereby a lumen maintenance factor of 94.8% is achieved, at 40% of rated life. This is better than the 92.3% achieved in a T8 lamp with SCAP (BAM is even lower).

The difference in maintenance factor for larger diameter lamps, such as T12, is less pronounced, due to lower wall loading. However the difference for small diameter lamps, such as CFL lamps having an ID of 13 mm, would be even greater.

Figure 4:
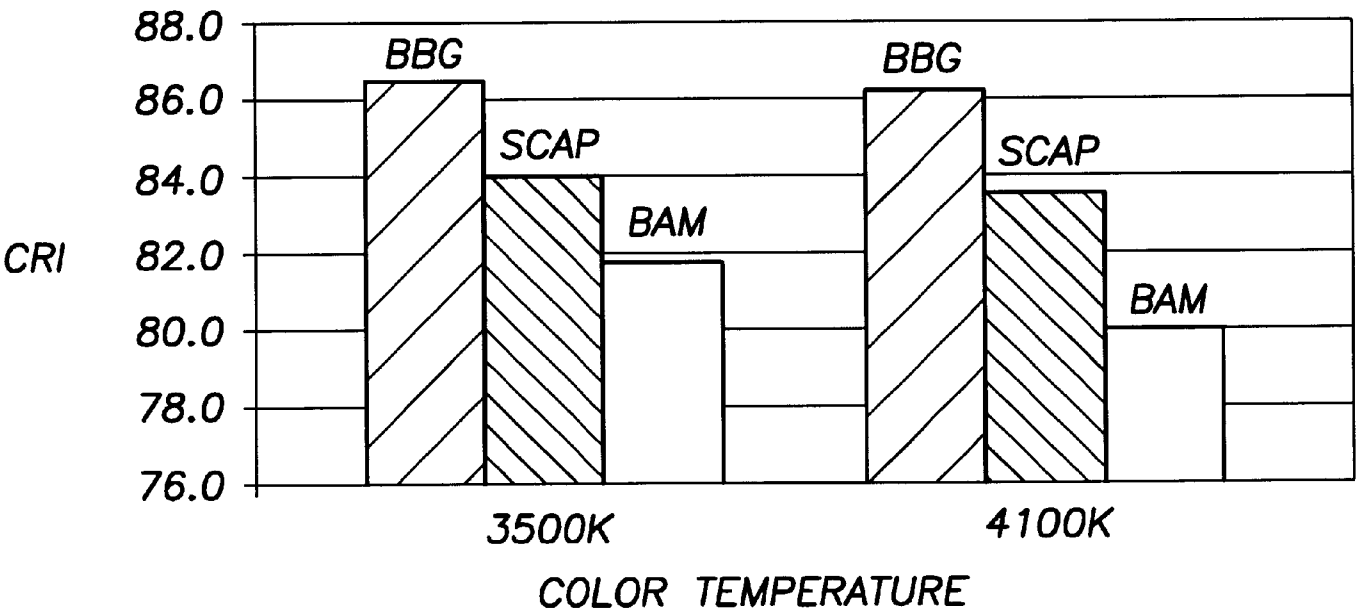
FIG. 4 compares CRI achieved with a lamp according to the invention, to CRI achieved with two prior art lamps.

FIG. 4A shows the CRI for the BBG/LAP/YOX mixture according to the invention, and the CRI for the BAM/LAP/YOX and SCAP/LAP/YOX mixtures of the prior art, for a 3500 K color temperature. FIG. 4B shows the CRI for the same mixtures, for a 4100 K color temperature. The higher CRI means that all colors are rendered more truly under a lamp according to the invention.

The foregoing is exemplary and not intended to limit the scope of the claims which follow.

What is claimed is:

1. An arc discharge lamp comprising a sealed discharge vessel enclosing a discharge space, said vessel having an inner surface, an ionizable medium in said discharge space, said medium comprising mercury and an inert gas, electrodes between which a discharge takes place in said ionizable medium during operation, and a layer of luminescent material on the inner surface of the vessel, the layer comprising a red phosphor, a green phosphor, and a blue-green phosphor consisting of barium magnesium aluminate activated by europium and manganese.

2. An arc discharge lamp as in claim 1 wherein said phosphors are mixed in such proportions that a color rendering index of 87 is achieved.

3. An arc discharge lamp as in claim 1 wherein said red phosphor comprises yttrium oxide activated by europium.

4. An arc discharge lamp as in claim 1 wherein said green phosphor comprises lanthanum phosphate activated by terbium and cerium.

5. An arc discharge lamp as in claim 1 wherein said vessel has a wall loading in the range of 200–400 W/m$^2$.

6. An arc discharge lamp as in claim 1 wherein:

said lamp further comprises a layer of alumina coated directly on the inner surface of the vessel, and said layer of luminescent material is coated directly on said layer of alumina.

7. An arc discharge lamp as in claim 1 wherein said layer of luminescent material consists of a multiplicity of particles having sizes on the order of a given size, and said layer has a thickness on the order of twice said given size.

8. An arc discharge lamp as in claim 7 wherein said given size is 6 $\mu$.

9. An arc discharge lamp comprising:

a sealed discharge vessel enclosing a discharge space, said vessel having an inner surface, an ionizable medium in said discharge space, said medium comprising mercury and an inert gas, electrodes between which a discharge takes place in said ionizable medium during operation, and a layer of luminescent material on the inner surface of the vessel, the layer comprising three phosphors only, said three phosphors consisting of a red phosphor, a green phosphor, and a blue-green phosphor consisting of barium magnesium aluminate activated by europium and manganese.

10. An arc discharge lamp as in claim 9 wherein said phosphors are mixed in such proportions that a color rendering index of 87 is achieved.

11. An arc discharge lamp as in claim 9 wherein said red phosphor comprises yttrium oxide activated by europium.

12. An arc discharge lamp as in claim 9 wherein said green phosphor comprises lanthanum phosphate activated by terbium and cerium.

13. An arc discharge lamp as in claim 9 wherein:

said lamp further comprises a layer of alumina coated directly on the inner surface of the vessel, and said layer of luminescent material is coated directly on said layer of alumina.

14. An arc discharge lamp as in claim 13 wherein said phosphors are mixed in such proportions that a color rendering index of 87 is achieved.

15. An arc discharge lamp as in claim 13 wherein said red phosphor comprises yttrium oxide activated by europium.

16. An arc discharge lamp as in claim 13 wherein said green phosphor comprises lanthanum phosphate activated by terbium and cerium.

17. An arc discharge lamp as in claim 13 wherein said vessel has a wall loading in the range of 200–400 W/m$^2$.

18. An arc discharge lamp as in claim 13 wherein:

said red phosphor comprises yttrium oxide activated by europium, said green phosphor comprises lanthanum phosphate activated by terbium and cerium, and said phosphors are mixed in such proportions that a color rendering index of 87 is achieved.

* * * * *